United States Patent [19]

Speak

[11] 4,391,565

[45] Jul. 5, 1983

[54] NOZZLE GUIDE VANE ASSEMBLIES FOR TURBOMACHINES

[75] Inventor: Trevor H. Speak, Gloucestershire, England

[73] Assignee: Rolls-Royce Limited, London, England

[21] Appl. No.: 266,493

[22] Filed: May 22, 1981

[30] Foreign Application Priority Data

May 31, 1980 [GB] United Kingdom ..... 8017888

[51] Int. Cl.[3] ..... F01D 9/04

[52] U.S. Cl. ..... 415/189; 415/190; 415/137

[58] Field of Search ..... 415/189, 190, 115, 137, 415/217

[56] References Cited

U.S. PATENT DOCUMENTS

| | | | |
|---|---|---|---|
| 2,980,396 | 4/1961 | Movsesian | 415/189 |
| 3,728,041 | 4/1973 | Bertelson | 415/189 |
| 3,970,318 | 7/1976 | Tuley | 415/172 R X |

FOREIGN PATENT DOCUMENTS

| | | | |
|---|---|---|---|
| 700012 | 11/1953 | United Kingdom | 415/217 |
| 347464 | 10/1972 | U.S.S.R. | 415/189 |

*Primary Examiner*—Harvey C. Hornsby
*Assistant Examiner*—Shewen Bian
*Attorney, Agent, or Firm*—Parkhurst & Oliff

[57] ABSTRACT

A nozzle guide vane assembly for a turbomachine comprises a plurality of segments mounted in an outer casing by means of pins which locate in slots. The slots are angled relative to radial planes so that the reaction force exerted by the pin normal to the length of the slot produces a tangential and radial force. The radial force opposes the couples produced on each segment by gas loads and the tangential reaction force.

3 Claims, 3 Drawing Figures

NOZZLE GUIDE VANE ASSEMBLIES FOR TURBOMACHINES

DESCRIPTION

This invention relates to nozzle guide vane assemblies for turbines of turbomachines.

It is known to construct nozzle guide vane assemblies in the form of a plurality of segments each comprising one or more guide vanes Each segment is located in the turbine casing at its upstream and downstream outer edges and the gas loads on the segments are reacted through these locations.

One known method of reacting loads that tend to cause the guide vane assembly to rotate in the turbine casing about the longitudinal axis of the engine is to provide axially extending pins in the casing which locate in radial slots in one corner of each segment. In this way the torque loads on the segment are reacted normal to the walls of the slot, i.e. tangentially.

Many of these prior known guide vane assemblies have location or fixing features such as flanges, pins, slots, bolts or rivets, which must be accurately aligned or positioned relative to the slots in the outer edge of the segments. It is easy and cheap to achieve accurate alignment of the inner location or fixing features with the slots if the slots are radial slots because machining tolerances are confined to the circumferential direction and it is easy to match these tolerances. Accordingly there is no incentive from the manufacturing and constructional points of view to use anything other than reaction pins locating in radial slots.

The invention as claimed resides in the appreciation that the known guide vane assemblies employing reaction pins located in radial slots suffer from the disadvantage that the circumferential and radial gas loads on the segment together with the tangential reaction force produced by the pin, generates a couple on each segment about an axis parallel to the longitudinal axis of the turbomachine to cause the segment to tilt. It is desirable to reduce tilting of the segments to maintain dimensional stability of the guide vane assembly and reduce the gas leakage through the turbine blade tip seals.

An object of the claimed invention is to provide a means of reacting torque loads produced on guide vane assemblies in such a way that tilting of the segments is reduced compared with that of segments with radially extending reaction slots.

According to the present invention there is provided a guide vane assembly for a turbomachine comprising a plurality of segments, each segment having one or more guide vanes, and each segment being mounted in an outer casing by means of a pin which locates in a slot, the slot being provided either in each segment or in the outer casing, and each pin being carried respectively either by the outer casing or by each segment, each slot being angled to a radial plane relative to the segment so that, in use, forces due to the gas loads acting on each segment are reacted by a force exerted by the pin in a direction normal to the length of the slot to provide a radially acting force on the segment that opposes a couple produced on the segment by tangential gas loads and the tangential component of the reaction forces.

Preferably the angle that each slot makes with the radial plane is such that the reaction force exerted by the pin normal to the length of the slot acts in a plane that bisects the resultant torque and radial gas loads on the segment.

The invention will now be described by way of an example with reference to the accompanying drawings in which.

Figure 1:
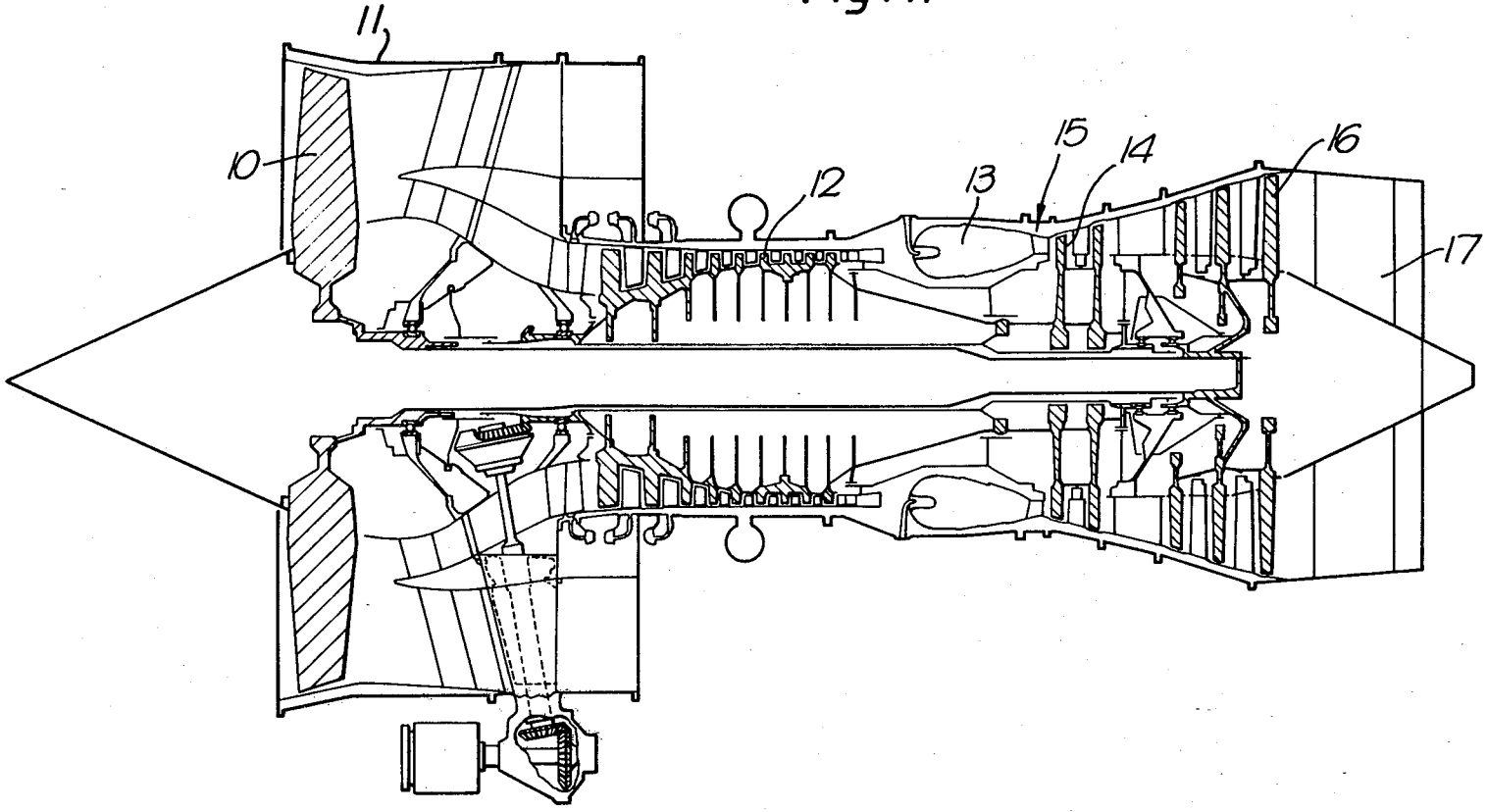
FIG. 1 illustrates a gas turbine engine incorporating a turbine nozzle guide vane assembly incorporating the present invention.

Referring to FIG. 1 there is shown a gas turbine engine of the by-pass type comprising a low pressure compressor fan 10 mounted in a by-pass duct 11, an axial flow high pressure compressor 12, a combustion chamber 13, a high pressure turbine 14 incorporating a nozzle guide vane assembly 15 constructed in accordance with the present invention, a low pressure turbine 16 and an exhaust nozzle 17.

Figure 2:
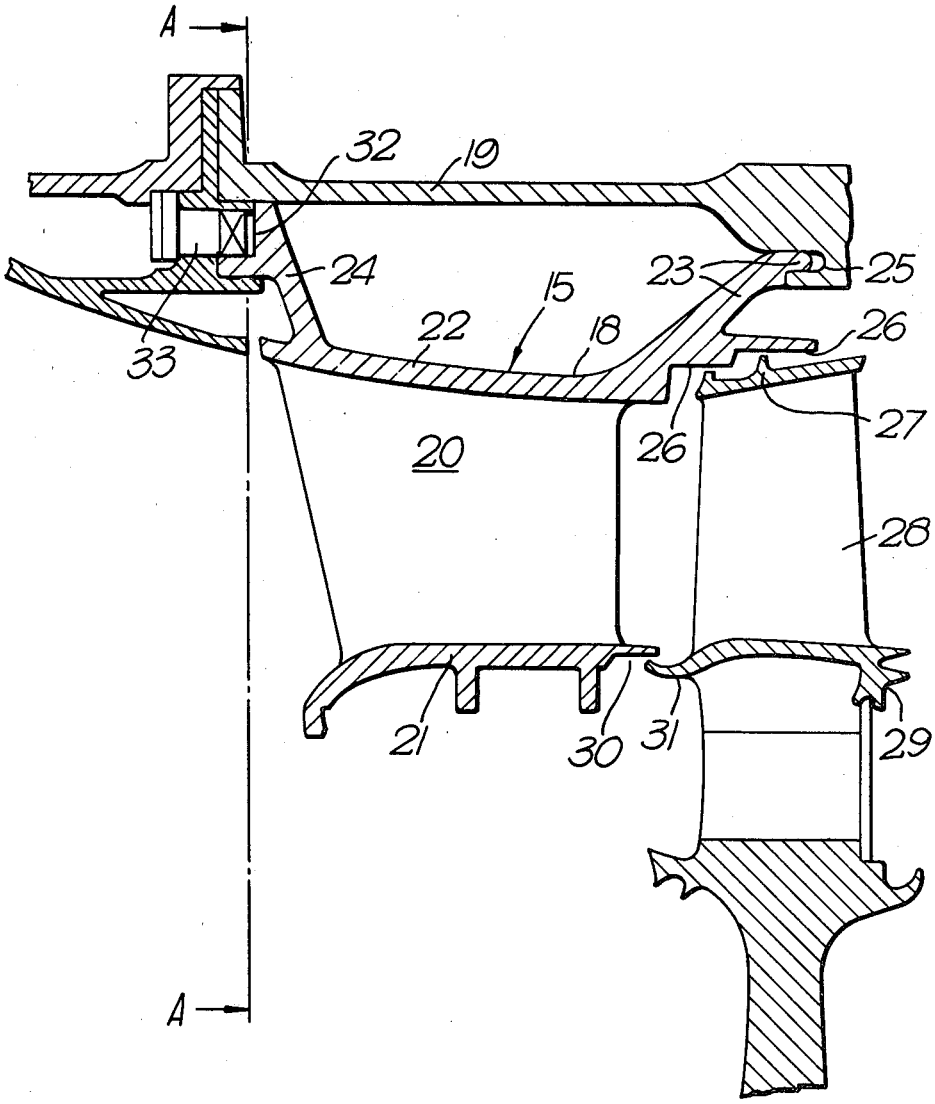
FIG. 2 is a view of part of the nozzle guide vane assembly of the engine of FIG. 1 sectioned in a radial plane extending along the rotational axis of the turbine.
Figure 3:
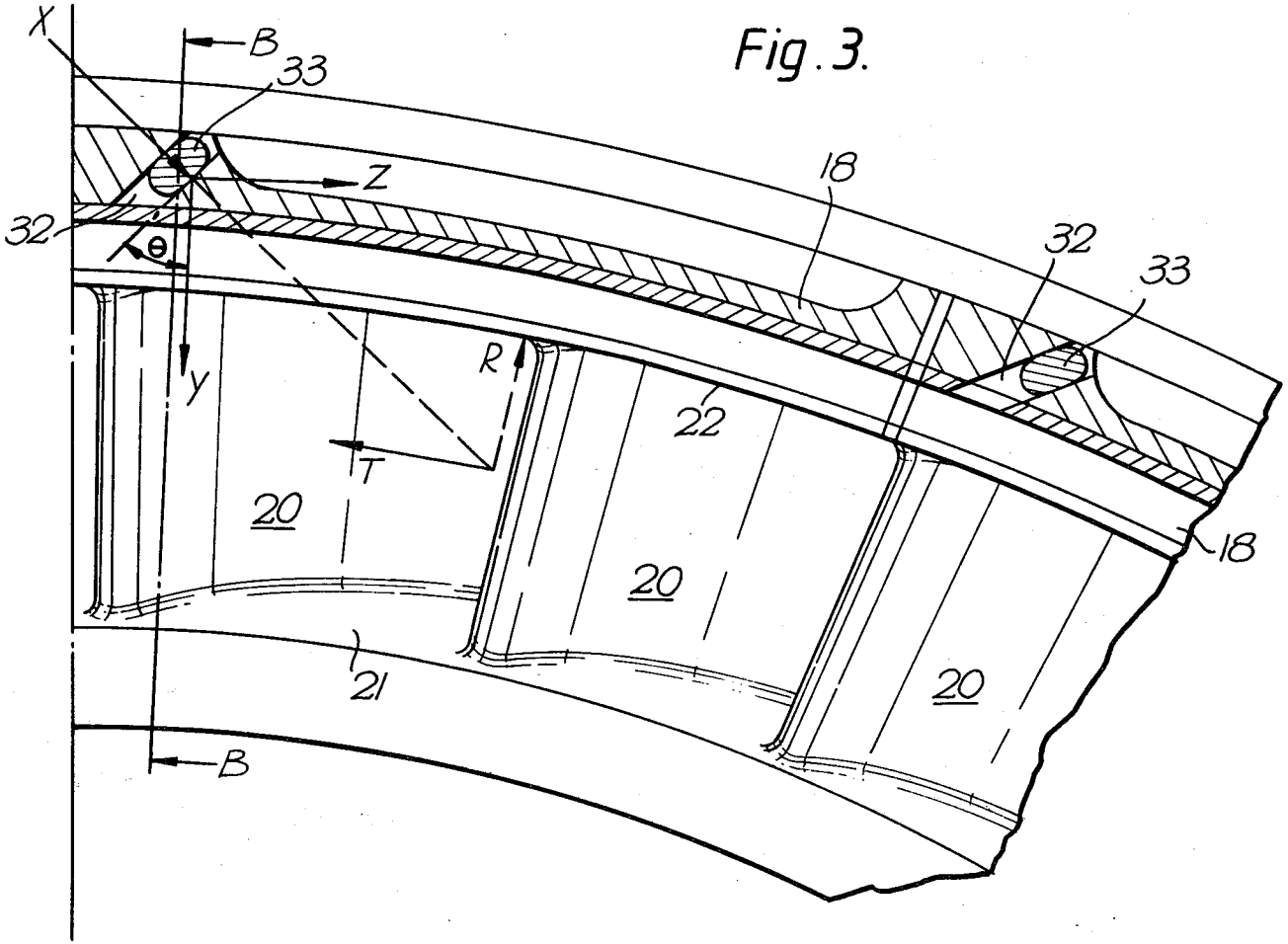
FIG. 3 is a cross sectional view taken along line A—A of FIG. 2.

The H.P. turbine nozzle guide vane assembly 15 is shown in greater detail in FIGS. 2 and 3. Referring to FIGS. 2 and 3 the nozzle guide vane assembly comprises a plurality of segments 18 mounted within the turbine outer casing 19. Each segment 18 comprises two guide vanes 20 supported between inner and outer platforms 21 and 22 respectively. The platforms 22 have integral flanges 23,24 at the leading and trailing edges of the segments. The flange 23 at the trailing edge of the segment locates in a circumferential recess 25 in the outer casing 19 and the flange 23 has concentric lands 26 against which the tip seals 27 of the turbine blades 28 of the turbine rotor 29 seal. Similarly, the inner platform 21 has a circumferential land 30 against which a seal member 31 of the blade root platform seals.

Each segment 18 is provided with a slot 32 (see FIG. 3) which is angled to a radial plane through the segment 18.

The outer casing 19 is provided with a plurality of pins 33, one for each segment, spaced around its inner circumference. Each pin 33 has two flats and locates in a slot 32 in a segment 18 and provides the means whereby the gas loads on each segment can be reacted by the outer casing. The angle $\theta$ that the slot makes with the radial plane is chosen so that the reaction forece X exerted by the pin 33 normal to the length of the slot 32 produces a radially inward force Y on the sgment, and a tangential force Z.

Referring to FIG. 2 the gas flow through the annular flow passage between the platforms 21,22 produces a force couple on each segment 18 that tends to rotate the segment (anti clockwise for the segment shown in FIG. 3). That is to say the leading edge of the segments tend to want to move radially inwards and the trailing edges radially outwards. This rotation is resisted by locating the flange 23 in the recess 25 to provide a radially inwards reaction force and by the radial forces Y produced at the pins 33.

Referring to FIG. 3 the gas flow produces a resultant force on the vanes that has an axial component and a tangential component (T). The tangential component together with the tangential reaction force Z produce a couple on the segment which causes each segment to rotate clockwise as viewed in FIG. 3. By angling the slot 32 in accordance with the present invention this couple can be opposed by the anticlockwise couple (as viewed in FIG. 3) constituted by the radial force Y and the radial gas load R which acts at the centre of pressure on the inside surface of the outer platform of the segment.

If the slots were not so angled in accordance with the present invention but were arranged to lie radially then there would not be a radial component of force to oppose the couple produced by forces T and Z and the segment would be unstable and would tilt.

In the above example, the slots 32 and pins 33 are provided adjacent the leading edge of the segments and the reaction force exerted by the pins 33 produce a radially inwards force Y. If the pins 33 and slots 32 are provided adjacent the trailing edge of the segments instead of the leading edge, then, in the example described, the pins are required to produce a tangential force Z (which opposes the torque due to gas loads) and a radially outward reaction force Y (to oppose the couple on the segment that rotates the segment anticlockwise as viewed in FIG. 2. Again this is achieved in the present invention by angling the slots 32 to the radial plane.

In the example described above the pins 33 are carried by the outercasing and the slots 32 are provided in each segment. If desired this may be reversed. That is to say, each segment may be provided with a pin which locates in a slot in the outer casing. Here again the slot would be angled to the radial plane sufficient to ensure that a radial reaction force will be produced on each segment.

I claim:

1. A guide vane assembly for a turbomachine comprising a plurality of segments, each segment having one or more guide vanes and each segment being mounted in an outercasing by means of a pin located in a slot wherein either the slot is provided in each segment and each pin is carried in the outer casing or the slot is in the outer casing and each pin is carried by each segment, each slot being angled to a radial plane relative to the segment so that, in use, forces due to the gas loads acting on each segment are reacted by a force exerted by the pin in a direction normal to the length of the slot, the radially inward component of the force exerted by each pin and the radially outward component of the gas load produces a first couple on the segment that opposes a second couple produced on the segment by the tangential component of the gas loads and the tangential component of the force exerted by the pin.

2. A guide vane assembly according to claim 1 wherein the angle that each slot makes with the radial plane is such that the reaction force exerted by the pin normal to the length of the slot acts in a plane that bisects the resultant torque and radial gas loads on the segment.

3. A guide vane assembly according to claim 1 wherein the pins have flats which contact side walls of the slots.

* * * * *